US010349791B1

(12) United States Patent
Neasham

(10) Patent No.: US 10,349,791 B1
(45) Date of Patent: Jul. 16, 2019

(54) TOILET DISINFECTING ASSEMBLY

(71) Applicant: Glenn Neasham, Hidden Valley Lake, CA (US)

(72) Inventor: Glenn Neasham, Hidden Valley Lake, CA (US)

( * ) Notice: Subject to any disclaimer, the term of this patent is extended or adjusted under 35 U.S.C. 154(b) by 0 days.

(21) Appl. No.: 16/155,092

(22) Filed: Oct. 9, 2018

(51) Int. Cl.
*A47K 10/42* (2006.01)
*A47K 10/32* (2006.01)

(52) U.S. Cl.
CPC .... *A47K 10/424* (2013.01); *A47K 2010/3266* (2013.01)

(58) Field of Classification Search
None
See application file for complete search history.

(56) References Cited

U.S. PATENT DOCUMENTS 5,062,546 A * 11/1991 Mackal ..... B63C 9/24 222/153.06
5,100,020 A 3/1992 Petterson
5,265,509 A 11/1993 Chen
6,318,590 B1 * 11/2001 McMurray-Stivers ..... A47K 10/3818 221/281
6,321,963 B1 * 11/2001 Gracyalny ..... A47K 10/3656 225/2
6,554,156 B1 * 4/2003 Chong ..... A47K 10/3818 221/303
7,311,619 B1 12/2007 Leftwich
7,621,401 B2 * 11/2009 Alegre de Miquel ..... A47K 10/421 206/233
7,856,941 B2 12/2010 Nelson
8,317,061 B2 * 11/2012 Vignot ..... A47K 10/42 221/45
9,198,546 B1 12/2015 Brown
2006/0121098 A1 6/2006 Mendoza
2009/0120951 A1 * 5/2009 Titas ..... A47K 10/3818 221/45
2010/0163569 A1 7/2010 Parker
2012/0228167 A1 9/2012 Sembritzki
2012/0248136 A1 * 10/2012 Meyers ..... A61L 2/22 221/96

* cited by examiner

*Primary Examiner* — Gene O Crawford
*Assistant Examiner* — Ayodeji T Ojofeitimi

(57) ABSTRACT

A toilet disinfecting assembly for disinfecting a toilet use and other hard surfaces in a bathroom includes a mount is removably coupled to a wall in a bathroom. A container containing a plurality of disinfecting wipes is provided and each of the disinfecting wipes is infused with a chemical disinfectant for disinfecting a hard surface. The container is positionable on the mount and each of the dispensing wipes is selectively removable from the container for wiping a toilet seat in the bathroom for disinfecting the toilet seat prior to use. A shell is provided and the shell is hingedly coupled to the mount. The shell is positionable in a closed position such that each of the shell and the mount forms a housing enclosing the container of disinfecting wipes. The shell is positionable in an open position to access the container of disinfecting wipes.

7 Claims, 8 Drawing Sheets

TOILET DISINFECTING ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to disinfecting devices and more particularly pertains to a new disinfecting device for disinfecting a toilet seat and other hard surfaces in a bathroom.

BRIEF SUMMARY OF THE INVENTION

An embodiment of the disclosure meets the needs presented above by generally comprising a mount is removably coupled to a wall in a bathroom. A container containing a plurality of disinfecting wipes is provided and each of the disinfecting wipes is infused with a chemical disinfectant for disinfecting a hard surface. The container is positionable on the mount and each of the dispensing wipes is selectively removable from the container for wiping a toilet seat in the bathroom for disinfecting the toilet seat prior to use. A shell is provided and the shell is hingedly coupled to the mount. The shell is positionable in a closed position such that each of the shell and the mount forms a housing enclosing the container of disinfecting wipes. The shell is positionable in an open position to access the container of disinfecting wipes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
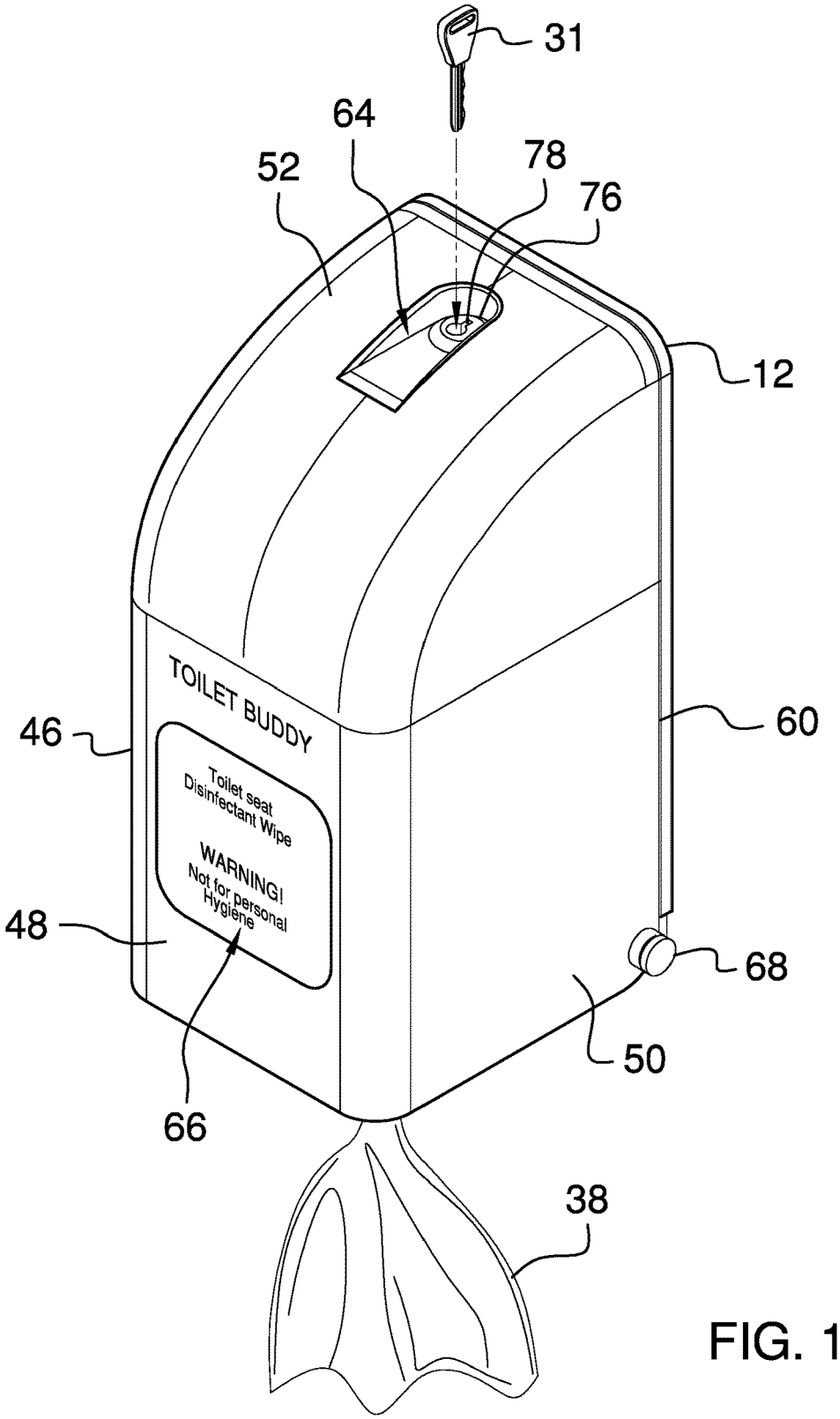
FIG. 1 is a perspective view of a toilet disinfecting assembly according to an embodiment of the disclosure.
Figure 2:
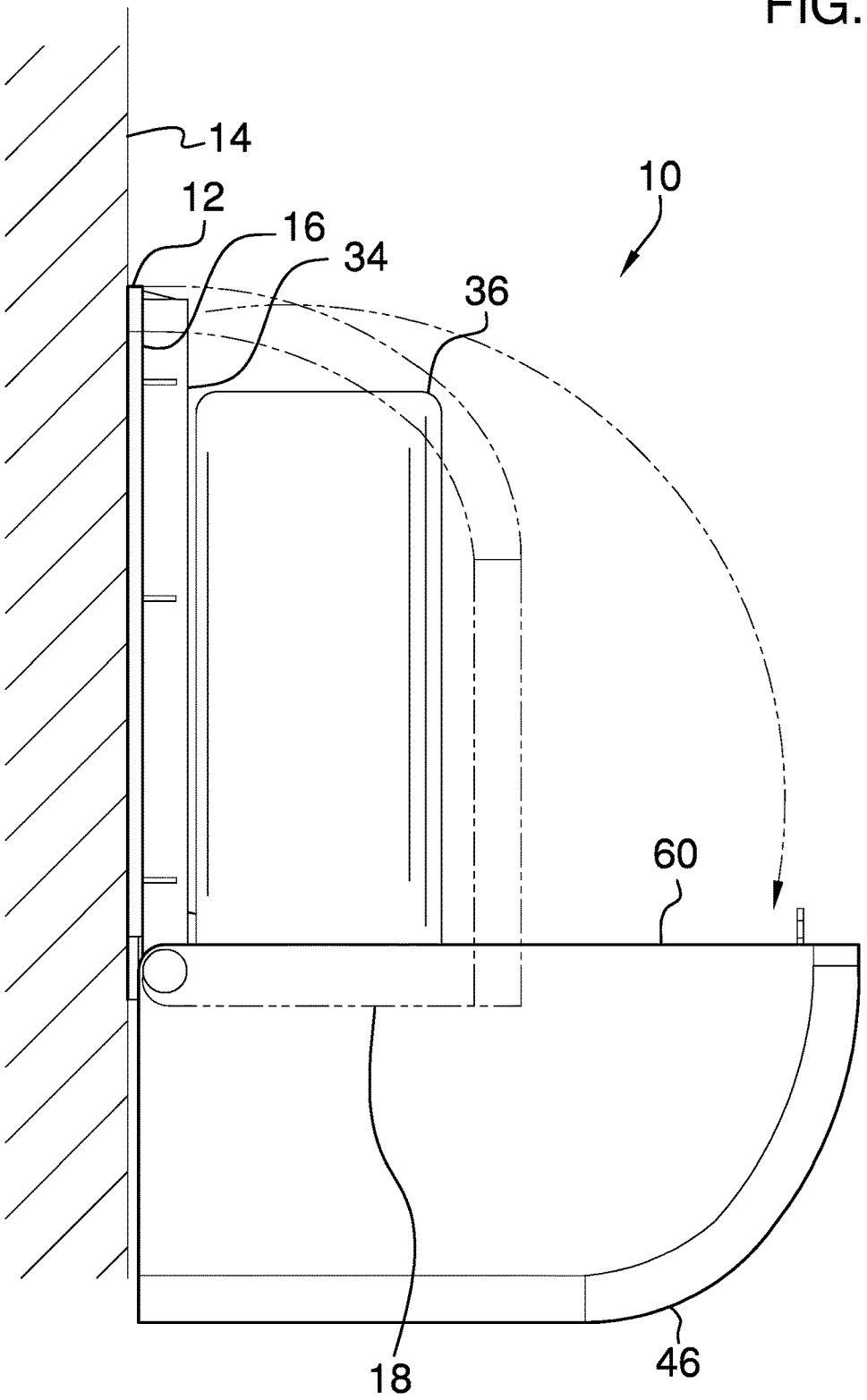
FIG. 2 is a left side view of an embodiment of the disclosure showing a shell being positioned in an open position.
Figure 3:
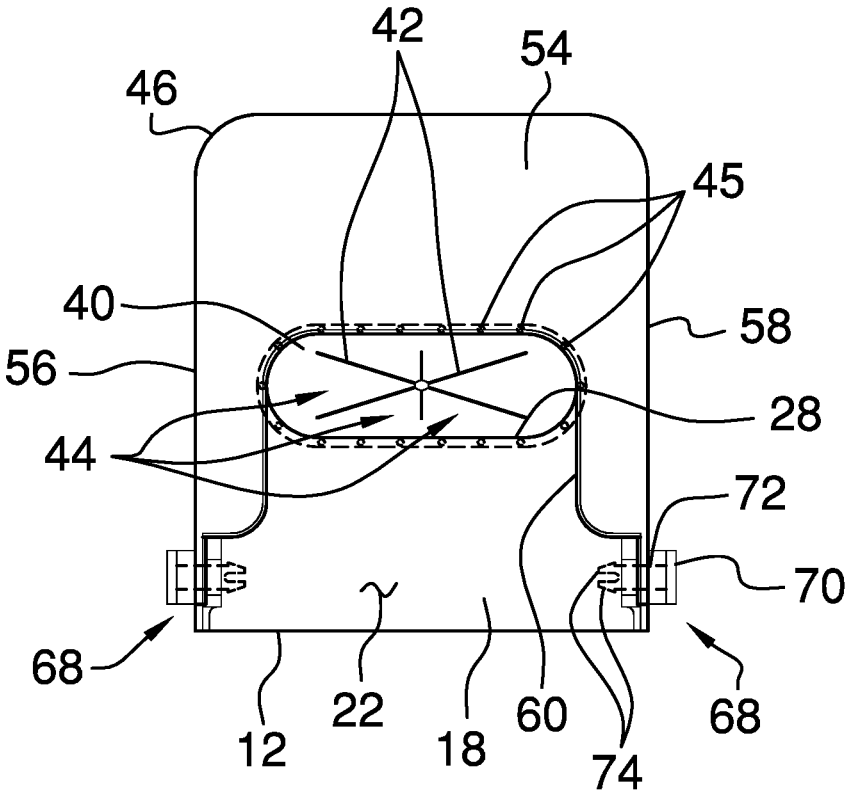
FIG. 3 is a bottom view of an embodiment of the disclosure.
Figure 4:
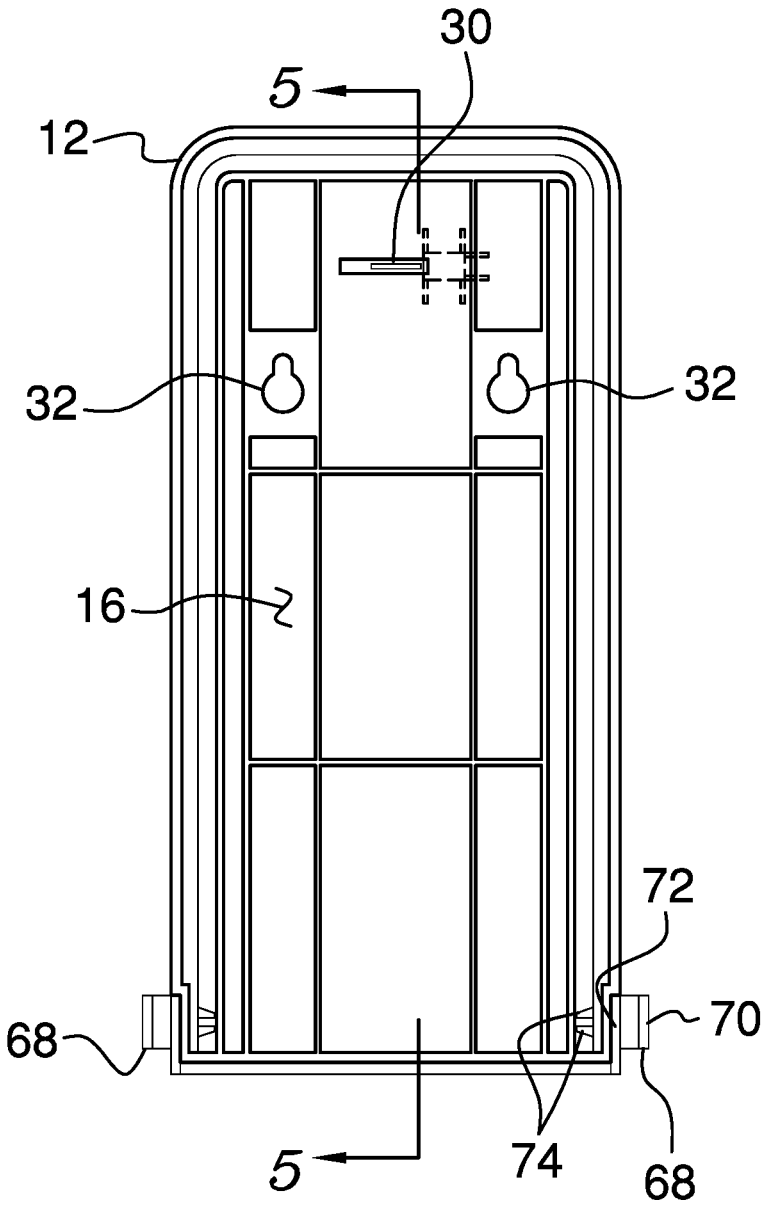
FIG. 4 is a back view of an embodiment of the disclosure.
Figure 5:
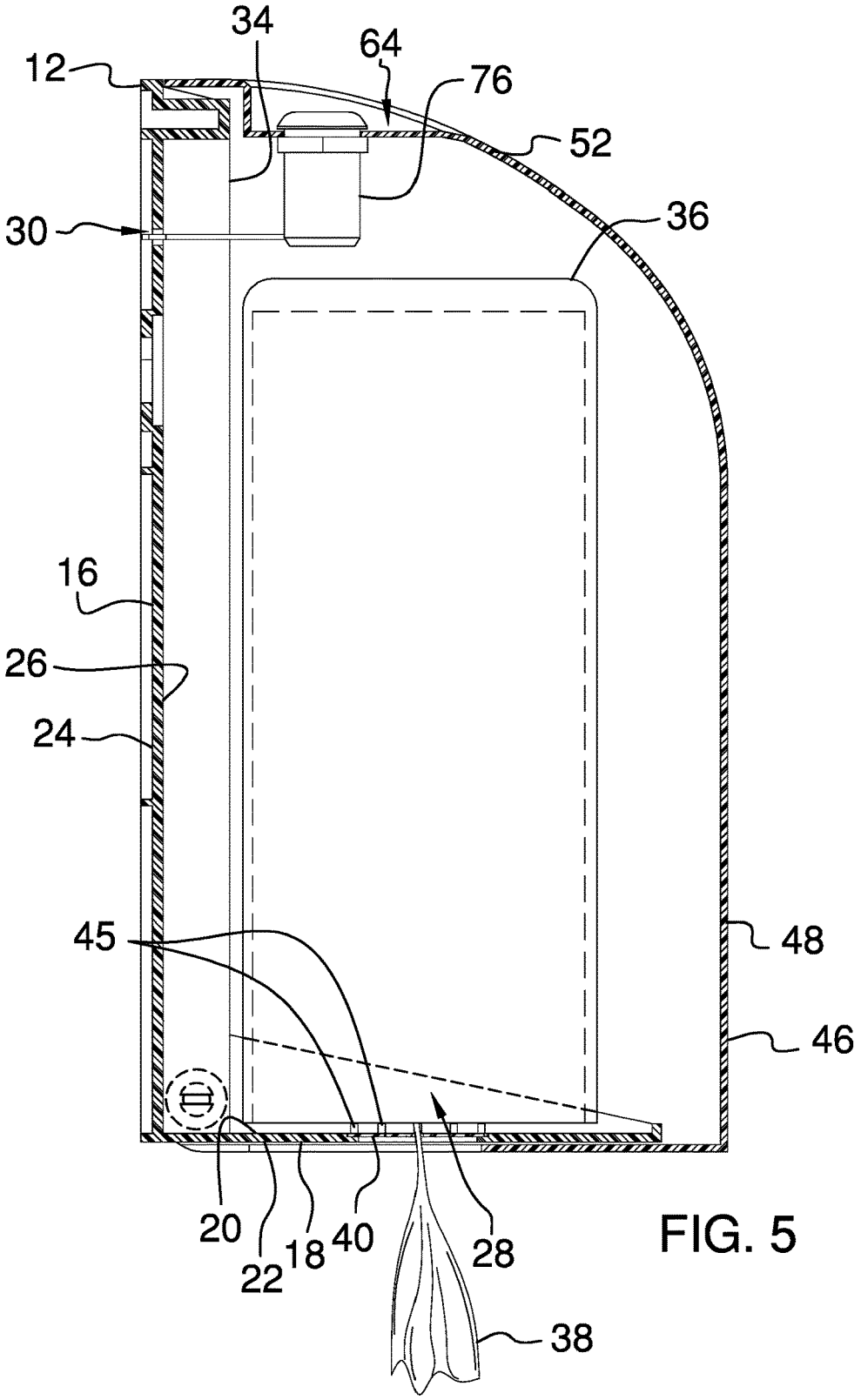
FIG. 5 is a cross sectional view taken along line 5-5 of FIG. 4 of an embodiment of the disclosure.

With reference now to the drawings, and in particular to FIGS. 1 through 8 thereof, a new disinfecting device embodying the principles and concepts of an embodiment of the disclosure and generally designated by the reference numeral 10 will be described.

As best illustrated in FIGS. 1 through 8, the toilet disinfecting assembly 10 generally comprises a mount 12 that is removably coupled to a wall 14 in a bathroom thereby facilitating the mount 12 to be positioned proximate a toilet. The bathroom may be a public bathroom and the toilet may be a plumbed toilet of any conventional design. The mount 12 has a back wall 16 and a bottom wall 18 that is coupled to and extends forwardly from the back wall 16, and the bottom wall 18 is oriented perpendicular to the back wall 16. The bottom wall 18 has a top surface 20 and a bottom surface 22, and the back wall 16 has a back surface 24 and a front surface 26. The bottom wall 18 has a dispenser aperture 28 extending through the top 20 and bottom 22 surfaces and the dispenser aperture 28 is centrally positioned on the bottom wall 18. Moreover, the dispenser aperture 28 is longitudinally elongated such that the dispenser aperture 28 has an ovoid shape.

The back wall 16 has a locking slot 30 extending through the front 22 and back 24 surfaces. The locking slot 30 is distally positioned with respect to the bottom wall 18. The back wall 16 has a pair of fastener openings 32 each extending through the front 22 and back 24 surfaces. Each of the fastener openings 32 insertably receives a respective one of a pair of fasteners in the wall of the bathroom for suspending the back wall 16 on the wall and having the bottom wall 18 being horizontally oriented. A lip 34 is coupled to and extends forwardly from the front surface 26 of the back wall 16 of the mount 12, and the lip 34 is coextensive with a perimeter of the back wall 16.

A container 36 is provided that contains a plurality of disinfecting wipes 38. Each of the disinfecting wipes 38 is infused with a chemical disinfectant for disinfecting a hard surface. Additionally, the chemical disinfectant is not intended for personal hygiene use. The container 36 is positionable on the bottom wall 18 having the container 36 being aligned with the dispenser aperture 28. Each of the disinfecting wipes 38 is selectively removable from the container 36 through the dispenser aperture 28. Each of the disinfecting wipes 38 can be wiped on a toilet seat in the bathroom for disinfecting the toilet seat prior to use. The container 36 of disinfecting wipes 38 may be similar to that manufactured and sold by The Clorox Company, 1221 Broadway, Oakland, Calif. 94612.

A dispenser 40 is coupled to the bottom wall 18 and the dispenser 40 is aligned with and covers the dispenser aperture 28. The dispenser 40 has a plurality of cuts 42 therein and each of the cuts 42 radiates outwardly from a center of the dispenser 40 thereby forming a plurality of intersecting flaps 44. The selected disinfecting wipe 38 is urgeable downwardly through the plurality of intersecting flaps 44 for removing the selected disinfecting wipe 38. The dispenser 40 may be comprised of resiliently deformable material such as rubber or the like. A plurality of pegs 45 is coupled to and extends upwardly from the top surface 20 of the bottom wall 18 of the mount 12. The pegs 45 are spaced apart from each other and are distributed around the dispenser aperture 28 for retaining the dispenser 40 in place over the dispenser aperture 28.

A shell 46 is provided and the shell 46 is hingedly coupled to the mount 12. The shell 46 is positionable in a closed position such that each of the shell 46 and the mount 12 forms a housing for enclosing the container 36 of disinfecting wipes 38. The shell 46 is positionable in an open position to access the container 36 of disinfecting wipes 38. The shell 46 has a front wall 48 and an outside wall 50 extending rearwardly therefrom. Additionally, the outside wall 50 has a top side 52, a bottom side 54, a first lateral side 56, a second lateral side 58 and a distal edge 60 with respect to the front wall 48. The distal edge 60 defines an opening 62 into the shell 46 and the top side 52 curves downwardly between the first 56 and second 58 lateral sides to join the front wall 48.

The bottom side 54 has a portion of the distal edge 60 associated therewith, and the distal edge 60 associated with the bottom side 54 extends forwardly on the bottom side 54 toward the front wall 48. The back edge of the shell 46 abuts the front surface 26 of the back wall 16 of the mount 12 and the distal edge 60 associated with the bottom side 54 extends around a perimeter of the bottom wall 18 of the mount 12 when the shell 46 is closed. Moreover, the shell 46 is tilted on the mount 12 having the distal edge 60 of the shell 46 being spaced from the front surface 26 of the back wall 16 of the mount 12 when the shell 46 is positioned in the open position. Each of the mount 12 and the shell 46 may have a width of approximately 117.0 mm and a height of approximately 280.8 mm thereby facilitating the container 36 as manufactured by The Clorox Company to be enclosed by the shell 46.

The top side 52 of the outer wall has a well 64 extending downwardly therein. The front wall 48 has indicia 66 is printed thereon. The indicia 66 may comprise the words "Toilet Buddy". "Toilet seat disinfecting wipe" and "Warning! Not for personal hygiene". A pair of hinges 68 each extends through the shell 46 and rotatably engages the mount 12 for hingedly coupling the shell 46 to the mount 12. Each of the hinges 68 extends through a respective one of the first 56 and second 58 lateral sides of the outside wall 50 of the shell 46 and rotatably engages the lip 34 on the back wall 16 of the mount 12.

Each of the hinges 68 comprises a disk 70 that has a first surface 72 and a pair of fingers 74. Each of the fingers 74 is coupled to and extends away from the first surface 72 of the disk 70 and each of the fingers 74 is biased away from each other on the disk 70. Each of the fingers 74 extends through the outside wall 50 of the shell 46 and releasably engages the lip 34 on the back wall 16 of the mount 12. Moreover, each of the fingers 74 is selectively urgeable toward each other for disengaging the lip 34 thereby facilitating the fingers 74 to be removed from the lip 34.

A lock 76 is coupled to the shell 46 and the lock 76 is positionable between a locked position and an unlocked position. The lock 76 engages the mount 12 when the shell 46 is closed and the lock 76 is positioned in the locked position thereby inhibiting the shell 46 from being positioned in the open position. The lock 76 disengages the mount 12 when the lock 76 is positioned in the unlocked position thereby facilitating the shell 46 to be positioned in the unlocked position. The lock 76 is positioned in the well 64 in the top side 52 of the outer wall of the shell 46 having a key hole 78 in the lock 76 being exposed. The key hole 78 receives the key 31 for locking and unlocking the lock 76, and the lock 76 may be a keyed tumbler lock or the like. The lock 76 facilitates the mount 12 and the shell 46 to be employed in a public restroom or the like. Additionally, the lock may have a length of 13/16 inch and a diameter of 18.0 mm.

Figure 6:
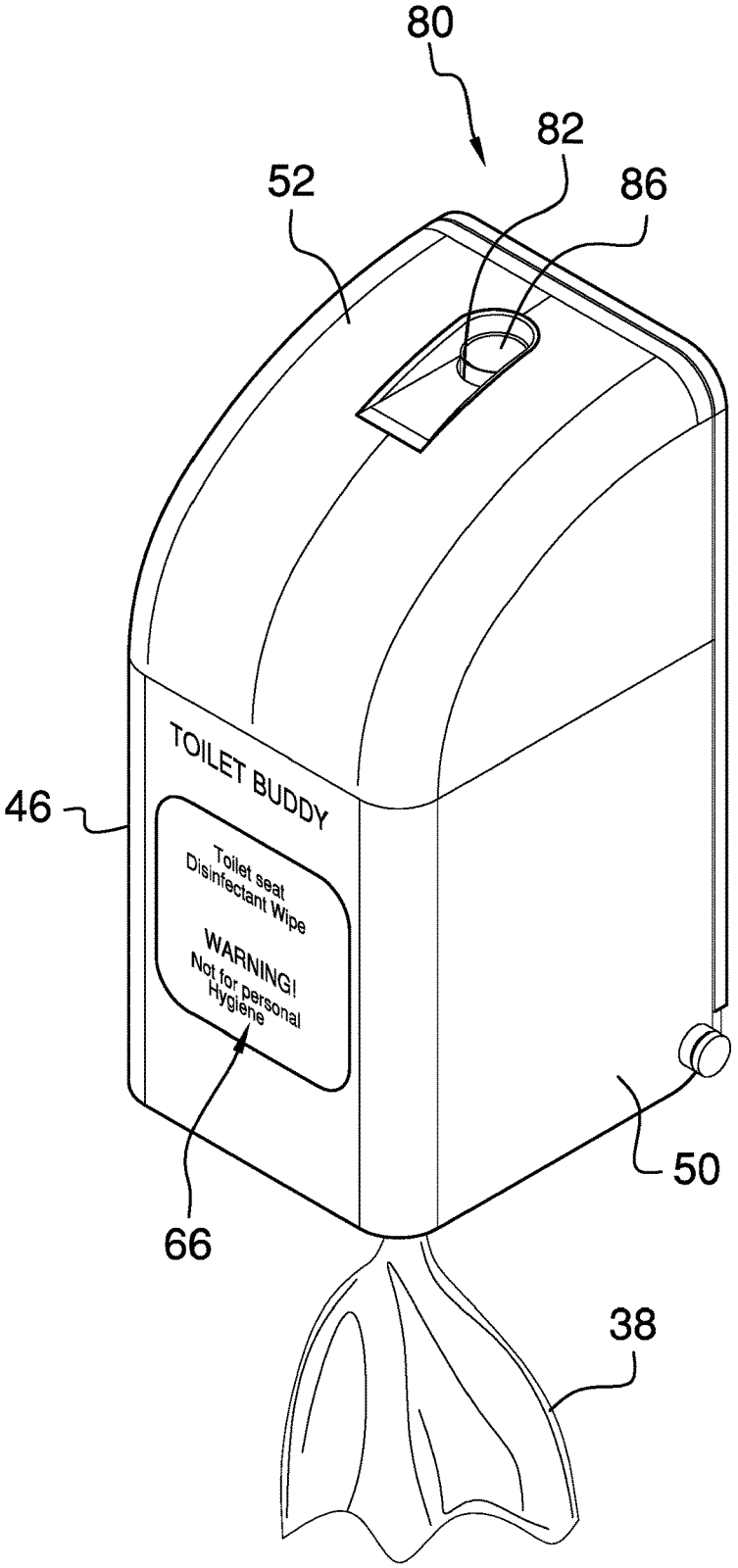
FIG. 6 is a perspective view of an alternative embodiment of the disclosure.
Figure 7:
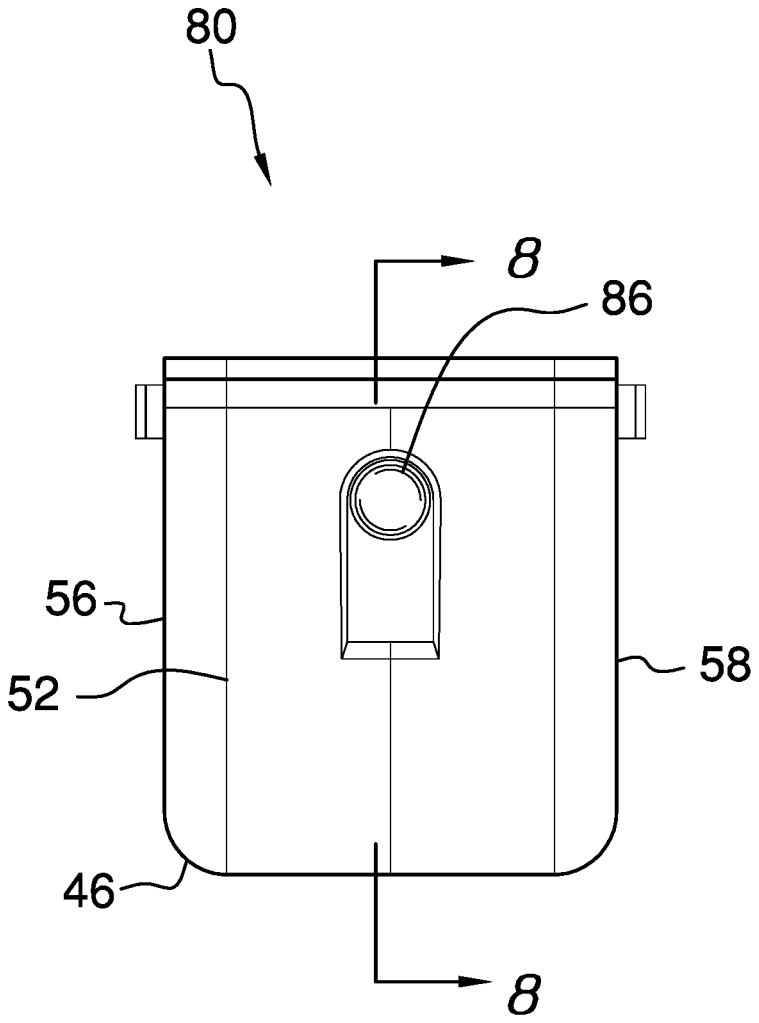
FIG. 7 is a top view of an alternative embodiment of the disclosure.
Figure 8:
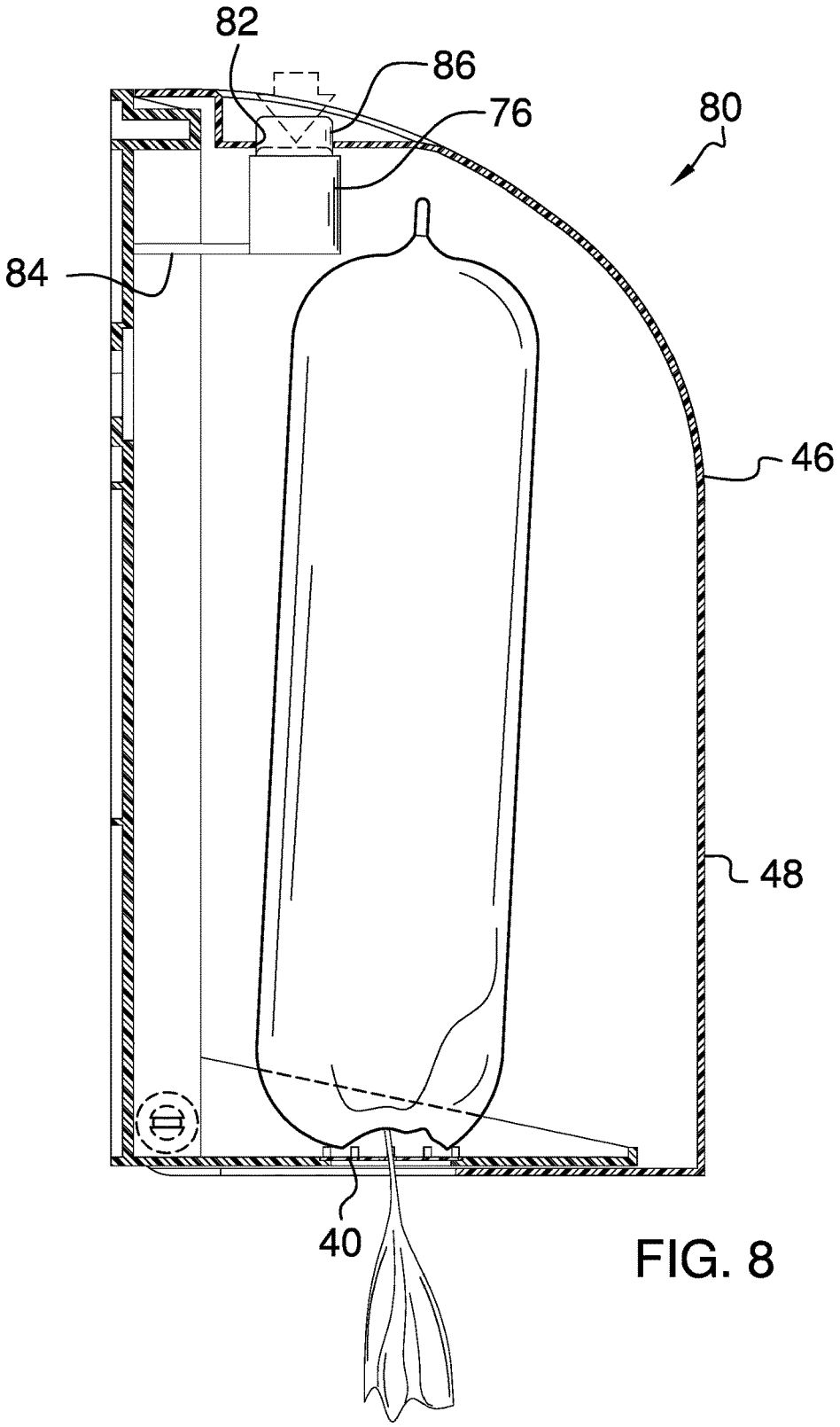
FIG. 8 is a cross sectional view taken along lie 8-8 of FIG. 7 of an embodiment of the disclosure.

In an alternative embodiment 80 as shown in FIGS. 6, 7 and 8, the top side 52 of the outside wall 50 of the shell 46 has a lock opening 82 extending therethrough. Continuing in the alternative embodiment 80, the lock 76 comprises a stem 84 that is removably coupled to and extends forwardly from the front surface 26 of the back wall 16 of the mount 12. The stem 84 includes a pair of engagements that each releasably engages the locking slot 30 in the back wall 16 of the mount 12. Thus, the stem 84 is removably coupled to the mount 12.

The lock 76 further includes a button 86 that is coupled to and extends upwardly from the stem 84. The button 86 is distally positioned with respect to the back wall 16 of the mount 12. The button 86 extends upwardly through the lock opening 82 in the top side 52 of the outside wall 50 of the shell 46 when the shell 46 is positioned in the closed position for retaining the shell 46 in the closed position. The button 86 is depressed downwardly through the lock 76 opening thereby facilitating the shell 46 to be positioned in the open position. The lock 76 in the alternative embodiment facilitates the mount 12 and the shell 46 to be employed in a private bathroom.

In use, the shell 46 is positioned in the open position and the container 36 of disinfecting wipes 38 is positioned on the bottom wall 18 of the mount 12. The shell 46 is closed and a selected one of the disinfecting wipes 38 is drawn downwardly through the dispenser 40. Thus, the disinfecting wipes 38 in the container 36 may be removed from the shell 46 and the mount 12. The disinfecting wipes 38 are employed for disinfecting the toilet seat on the toilet, or other hard surfaces in the bathroom. In this way the toilet seat can be sanitized prior to use, thereby enhancing cleanliness for individuals using the toilet. The shell 46 is opened and the container 36 of disinfecting wipes 38 is replaced when the container 36 of disinfecting wipes 38 is empty.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet disinfecting assembly being configured to contain and dispense a surface disinfectant for disinfecting a toilet seat, said assembly comprising:

a mount being removably coupled to a wall in a bathroom wherein said mount is configured to be positioned proximate a toilet, said mount having a back wall and a bottom wall being coupled to and extending forwardly from said back wall, said bottom wall being oriented perpendicular to said back wall, said bottom wall having a top surface and a bottom surface, said back wall having a back surface and a front surface, said bottom wall having a dispenser aperture extending through said top and bottom surfaces, said dispenser aperture being centrally positioned on said bottom wall, said dispenser aperture being longitudinally elongated such that said dispenser aperture has an ovoid shape, said back wall having a locking slot extending through said front and back surfaces, said locking slot insertably receiving a key, said locking slot being distally positioned with respect to said bottom wall, said back wall having a pair of fastener openings each extending through said front and back surfaces, each of said fastener openings insertably receiving a respective one of a pair of fasteners in the wall for suspending said back wall on the wall having said bottom wall being horizontally oriented, said mount having a lip being coupled to and extending forwardly from said front surface of said back wall of said mount, said lip being coextensive with a perimeter of said back wall;

a container containing a plurality of disinfecting wipes, each of said disinfecting wipes being infused with a chemical disinfectant for disinfecting a hard surface, said container being positionable on said mount, each of said dispensing wipes being selectively removable from said container wherein each of said disinfecting wipes is configured to be wiped on a toilet seat in the bathroom for disinfecting the toilet seat prior to use;

a shell being hingedly coupled to said mount, said shell being positionable in a closed position such that each of said shell and said mount forms a housing enclosing said container of disinfecting wipes, said shell being positionable in an open position to access said container of disinfecting wipes, said shell having a front wall and an outside wall extending rearwardly therefrom, said outside wall having a top side, a bottom side, a first lateral side, a second lateral side and a distal edge with respect to said front wall, said distal edge defining an opening into said shell, said top side curving downwardly between said first and second lateral sides to join said front wall, said bottom side having a portion of said distal edge being associated therewith, said distal edge associated with said bottom side extending forwardly toward said front wall, said back edge of said shell abutting said front surface of said back wall of said mount and having said distal edge associated with said bottom side extending around a perimeter of said bottom wall of said mount when said shell is closed, said shell being tilted on said mount having said distal edge of said shell being spaced from said front surface of said back wall of said mount when said shell is positioned in said open position, said top side of said outer wall having a well extending downwardly therein; and a pair of hinges, each of said hinges extending through said shell and rotatably engaging said mount for hingedly coupling said shell to said mount, each of said hinges extending through a respective one of said first and second lateral sides of said outside wall of said shell and rotatably engages said lip on said back wall of said mount, each of said hinges comprises a disk having a first surface, and a pair of fingers, each of said fingers being coupled to and extending away from said first surface of said disk, each of said fingers being biased away from each other on said disk, each of said fingers extending through said outside wall of said shell and releasably engaging said lip on said back wall of said mount, each of said fingers being selectively urgeable toward each other for disengaging said lip thereby facilitating said fingers to be removed from said lip.

2. The assembly according to claim 1, further comprising a dispenser being coupled to said mount, bottom wall, said dispenser being aligned with and covering said dispenser aperture, said dispenser having a plurality of cuts therein, each of said cuts radiating outwardly from a center of said dispenser thereby forming a plurality of intersecting flaps, said selected disinfecting wipe being urgeable downwardly through said plurality of intersecting flaps for removing said selected disinfecting wipe.

3. The assembly according to claim 1, further comprising said front wall having indicia being printed thereon, said indicia comprising the words "Toilet Buddy", "Toilet seat disinfecting wipe" and "Warning! Not for personal hygiene".

4. The assembly according to claim 1, further comprising a lock being coupled to said shell, said lock being positionable between a locked position and an unlocked position, said lock engaging said mount when said shell is closed and said lock is positioned in said locked position thereby inhibiting said shell from being positioned in said open position, said lock disengaging said mount when said lock is positioned in said unlocked position thereby facilitating said shell to be positioned in said unlocked position, said lock being positioned in said well in said top side of said outer wall of said shell having a key hole in said lock being exposed, said key hole receiving said key for locking and unlocking said lock.

5. A toilet disinfecting assembly being configured to contain and dispense a surface disinfectant for disinfecting a toilet seat, said assembly comprising:

a mount being removably coupled to a wall in a bathroom wherein said mount is configured to be positioned proximate a toilet, said mount having a back wall and a bottom wall being coupled to and extending forwardly from said back wall, said bottom wall being oriented perpendicular to said back wall, said bottom wall having a top surface and a bottom surface, said back wall having a back surface and a front surface, said bottom wall having a dispenser aperture extending through said top and bottom surfaces, said dispenser aperture being centrally positioned on said bottom wall, said dispenser aperture being longitudinally elongated such that said dispenser aperture has an ovoid shape, said back wall having a locking slot extending through said front and back surfaces, said locking slot insertably receiving a key, said locking slot being distally positioned with respect to said bottom wall, said back wall having a pair of fastener openings each extending through said front and back surfaces, each of said fastener openings insertably receiving a respective one of a pair of fasteners in the wall for suspending said back wall on the wall having said bottom wall being horizontally oriented;

a lip being coupled to and extending forwardly from said front surface of said back wall of said mount, said lip being coextensive with a perimeter of said back wall;

a container containing a plurality of disinfecting wipes, each of said disinfecting wipes being infused with a chemical disinfectant for disinfecting a hard surface, said container being positionable on said bottom wall having said container being aligned with said dispensing aperture, each of said dispensing wipes being selectively removable from said container through said dispensing aperture wherein each of said disinfecting wipes is configured to be wiped on a toilet seat in the bathroom for disinfecting the toilet seat prior to use;

a dispenser being coupled to said bottom wall, said dispenser being aligned with and covering said dispenser aperture, said dispenser having a plurality of cuts therein, each of said cuts radiating outwardly from a center of said dispenser thereby forming a plurality of intersecting flaps, said selected disinfecting wipe being urgeable downwardly through said plurality of intersecting flaps for removing said selected disinfecting wipe;

a shell being hingedly coupled to said mount, said shell being positionable in a closed position such that each of said shell and said mount forms a housing enclosing said container of disinfecting wipes, said shell being positionable in an open position to access said container of disinfecting wipes, said shell having a front wall and an outside wall extending rearwardly therefrom, said outside wall having a top side, a bottom side, a first lateral side, a second lateral side and a distal edge with respect to said front wall, said distal edge defining an opening into said shell, said top side curving downwardly between said first and second lateral sides to join said front wall, said bottom side having a portion of said distal edge being associated therewith, said distal edge associated with said bottom side extending forwardly toward said front wall, said back edge of said shell abutting said front surface of said back wall of said mount and having said distal edge associated with said bottom side extending around a perimeter of said bottom wall of said mount when said shell is closed, said shell being tilted on said mount having said distal edge edge of said shell being spaced from said front surface of said back wall of said mount when said shell is positioned in said open position, said top side of said outer wall having a well extending downwardly therein, said front wall having indicia being printed thereon, said indicia comprising the words "Toilet Buddy", "Toilet seat disinfecting wipe" and "Warning! Not for personal hygiene";

a pair of hinges, each of said hinges extending through said shell and rotatably engaging said mount for hingedly coupling said shell to said mount, each of said hinges extending through a respective one of said first and second lateral sides of said outside wall of said shell and rotatably engaging said lip on said back wall of said mount, each of said hinges comprising:

a disk having a first surface; and a pair of fingers, each of said fingers being coupled to and extending away from said first surface of said disk, each of said fingers being biased away from each other on said disk, each of said fingers extending through said outside wall of said shell and releasably engaging said lip on said back wall of said mount, each of said fingers being selectively urgeable toward each other for disengaging said lip thereby facilitating said fingers to be removed from said lip; and a lock being coupled to said shell, said lock being positionable between a locked position and an unlocked position, said lock engaging said mount when said shell is closed and said lock is positioned in said locked position thereby inhibiting said shell from being positioned in said open position, said lock disengaging said mount when said lock is positioned in said unlocked position thereby facilitating said shell to be positioned in said unlocked position, said lock being positioned in said well in said top side of said outer wall of said shell having a key hole in said lock being exposed, said key hole receiving said key for locking and unlocking said lock.

6. The assembly according to claim 5, wherein said top side of said outer wall of said shell has a lock opening extending therethrough.

7. The assembly according to claim 6, wherein said lock comprises a stem being removably coupled to and extending forwardly from said front surface of said back wall of said mount and a button being coupled to and extending upwardly from said stem, said button being distally positioned with respect to said back wall of said mount, said button extending upwardly through said lock opening in said top wall of said outer wall of said shell when said shell is positioned in said closed position for retaining said shell in said closed position, said button being depressed downwardly through said lock opening thereby facilitating said shell to be positioned in said open position.

* * * * *